US012351410B2

(12) United States Patent
Lanigan et al.

(10) Patent No.: US 12,351,410 B2
(45) Date of Patent: Jul. 8, 2025

(54) PRINTER WITH LINERLESS MEDIA WRAP REMOVAL MECHANISM AND ASSOCIATED METHODS

(71) Applicant: ZEBRA TECHNOLOGIES CORPORATION, Lincolnshire, IL (US)

(72) Inventors: Daniel P. Lanigan, Elgin, IL (US); Edward C. Thomas, Gurnee, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 173 days.

(21) Appl. No.: 18/203,972

(22) Filed: May 31, 2023

(65) Prior Publication Data

US 2024/0400328 A1 Dec. 5, 2024

(51) Int. Cl.

| | |
|---|---|
| ***B41J 11/04*** | (2006.01) |
| ***B65H 16/02*** | (2006.01) |
| ***B65H 16/06*** | (2006.01) |
| ***B65H 16/10*** | (2006.01) |
| ***B65H 27/00*** | (2006.01) |

(52) U.S. Cl.

CPC ..... *B65H 16/028* (2013.01); *B65H 16/06* (2013.01); *B65H 16/106* (2013.01); *B65H 27/00* (2013.01); *B65H 2402/442* (2013.01); *B65H 2801/12* (2013.01)

(58) Field of Classification Search

CPC ..... B41J 11/02; B41J 11/04; B65H 75/12; B65H 2301/4132; B65H 2404/62; B65H 35/06

See application file for complete search history.

(56) References Cited

U.S. PATENT DOCUMENTS

| | | | | |
|---|---|---|---|---|
| 1,243,763 | A | 10/1917 | Rinsche | |
| 6,095,704 | A | 8/2000 | Jaeger et al. | |
| 2006/0280541 | A1 | 12/2006 | Lass, Jr. | |
| 2010/0124451 | A1 | 5/2010 | Hiroike et al. | |
| 2010/0319561 | A1* | 12/2010 | Colquitt | B41J 2/325 101/477 |
| 2011/0250000 | A1* | 10/2011 | Anderson | B41J 29/00 400/578 |
| 2015/0151538 | A1* | 6/2015 | Chen | B41J 2/14 347/37 |
| 2021/0229473 | A1 | 7/2021 | Preliasco et al. | |

OTHER PUBLICATIONS

PCT/US2024/026855—International Search Report.
PCT/US2024/026855—Written Opinion of the International Searching Authority (ISA).

* cited by examiner

*Primary Examiner* — Kristal Feggins

(57) ABSTRACT

A printer is disclosed that includes a platen roller assembly, a frame, and a drive assembly. The drive assembly is operatively coupled to a first mating structure at a proximal end of an axle of the platen roller assembly to automatically rotate the axle via the proximal end of the axle during a printing operation. The axle is manually rotated in situ via a second mating structure at a distal end during an operation to remove linerless media wrapped around the platen roller assembly.

20 Claims, 11 Drawing Sheets

PRINTER WITH LINERLESS MEDIA WRAP REMOVAL MECHANISM AND ASSOCIATED METHODS

BACKGROUND

Linerless labels were developed to reduce the quantity of waste produced during label printing using convention liner-based labels. Linerless labels are those labels that are printed and used without conventional release layers or liners. Liners are typically used to support pressure sensitive adhesive labels as they move through a printer. Liners protect the adhesive surface of the label from environmental contaminants and also reduce the incidence of printer binding or jamming.

One challenge of using linerless labels is that the exposed adhesive surface of the linerless label media can undesirably adhere or stick to components of the printer, thereby complicating the operation of the printer. For example, the adhesive surface of the linerless label media can adhere and can become wrapped around the platen roller of the printer, thereby jamming (and possibly damaging) the platen roller and/or other components of the printer. Adhesion of the linerless label media to the platen roller can result from normal use and/or can be exacerbated by certain operating conditions, such as extreme temperatures, high humidity, other environmental conditions, adhesive deposits, prolonged pauses in operation, and the like.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
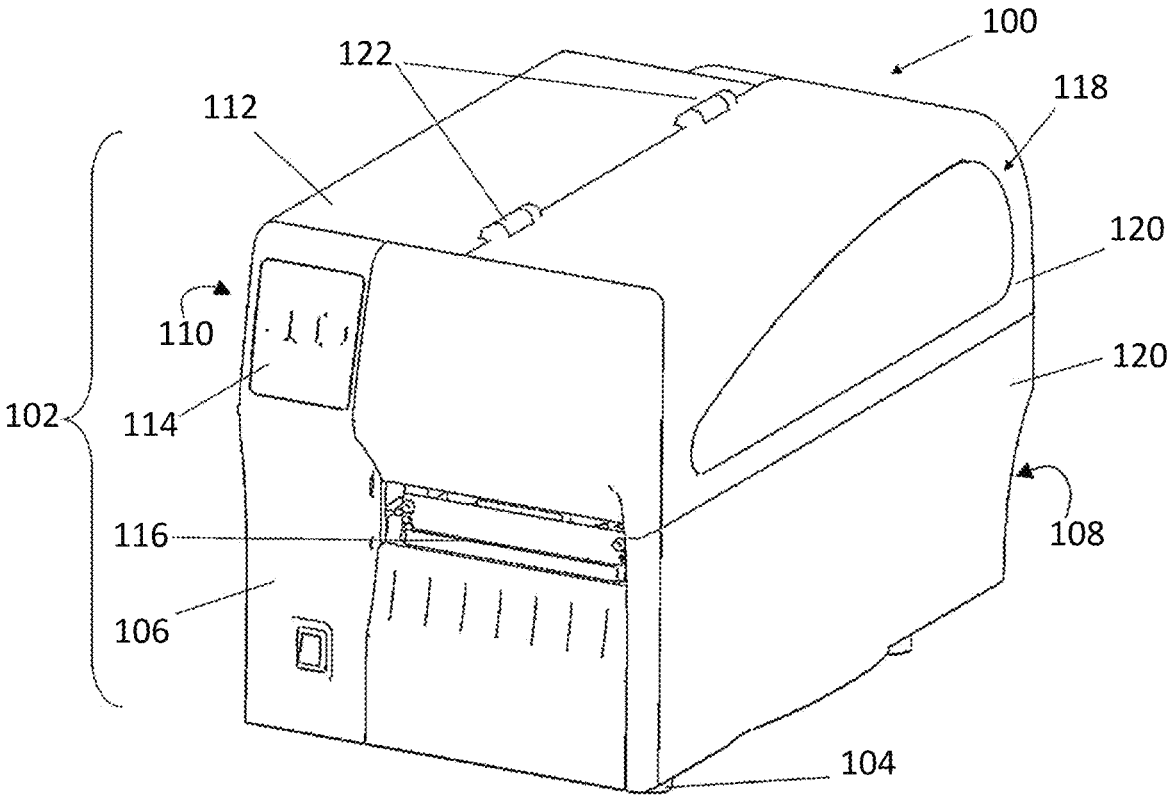
FIG. 1 illustrates an example media processing device in accordance with embodiments of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The components of embodiments of the present disclosure have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Embodiments of printers and media processing devices of the present disclosure can process (e.g., print, encode, etc.) media by drawing the media from the media source and routing the media proximate various processing components (e.g., printhead, RFID reader/encoder, magnetic stripe reader/encoder etc.). Processing the media from the media source may facilitate a continuous or batch printing process. As an example, embodiments of printers and media processing devices of the present disclosure may be configured to print and/or encode media drawn from a media source, such as roll, spool, or fanfold. Such media may include a continuous web such as a spool of linerless media. The continuous web of linerless media is coated on one surface with a pressure sensitive adhesive and includes a printable surface on the opposite surface. For thermal transfer printing, the printable surface of the linerless media is configured to receive a pigment (e.g., ink, resin, wax-resin, etc.) that is transferred from a ribbon supply. For direct thermal printing, a thermal printhead of the printer directly contacts the printable surface triggering a chemical and/or physical change in a thermally sensitive dye covering and/or embedded in at least a portion of the printable surface of the media.

The web of linerless media is routed along a feed path from the media supply to a print position located adjacent to the printhead (e.g., a thermal printhead). The continuous web of linerless media is pulled through the feed path by a driven platen roller. The platen roller is designed to contact the adhesive surface of the linerless media as it pulls the linerless media through the feed path. The printhead is generally configured to form a nip with the platen roller to pinch the linerless media between the printhead and the platen roller. This pinching or compressive force provides adequate print quality, and in some applications, ensures that a sufficient tension is maintained along the continuous web of linerless media. Once printed, the printed portion of the linerless label media is advanced outwardly from the printer through a media outlet by the platen roller where it can be cut and/or torn to separate the printed label from the media supply.

As the media is fed past the platen roller, the adhesive of the linerless media can cause the linerless media to adhere to the platen roller as the platen roller assembly rotates. As a result, the media can adhere to and/or wrap around the platen roller and/or jam at the platen roller. Removal of the media wrap on the platen roller can be difficult because access to the platen roller in situ is limited due to operational and structure constraints of the printer. For example, the components of the printers are typically positioned close together within an internal cavity of a housing having limited spaced. For instance, the media outlet or exit is generally too narrow for a user to access the platen roller through the media exit, and when a door assembly of the printer is in the open position to expose an internal cavity, a printhead assembly and/or cutter assembly can be positioned in a manner that makes it difficult to reach the platen roller and remove the wrapped media from the platen roller. For example, in an engaged position, the printhead is positioned adjacent to platen roller typically leaving just enough space for the thickness of the media to pass through. In a disengaged position, the printhead can be move away from the platen roller. However, the movement of the printhead assembly is also limited such that there is typically less than about one inch between the printhead and the platen roller. As another example, the cutting assembly can be positioned between the platen roller and the media exit and can further impede access to the platen roller. As another example, the non-driven or distal end of the platen roller is typically retained within a frame, and in some instances, only extends a small distance (e.g., less than one hundredth of an inch) such that manipulation of the distal end of the platen roller is typically not possible or practical.

In accordance with embodiments of the present disclosure, a printer and/or media processing device is disclosed. The printer and/or media processing device includes a platen roller assembly, a frame, and a drive assembly. The platen roller assembly includes an axle, a first bearing, a second, bearing, an outer core, and a clip. The axle has a cylindrical outer surface and extends from a proximal end to a distal end. The first bearing is disposed circumferentially about the axle proximate to the proximal end. The second bearing is disposed circumferentially about the axle proximate to the distal end of the axle. The outer core is disposed circumferentially about the axle between the first and second platen bearings. The clip is disposed circumferentially about the axle between the distal end and the second bearing to retain the second bearing on the axle. The proximal end of the axle includes a first mating structure and the distal end of the axle has a second mating structure integrally formed in the distal end. The frame supports the platen roller assembly. The distal end of the axle extends beyond the frame and/or bearing by less than approximately one-hundredth of an inch. The drive assembly is operatively coupled to the first mating structure at the proximal end of the axle. The axle of the platen roller assembly is automatically rotated via the drive assembly coupled to the first mating structure at the proximal end during a printing operation and is manually rotated in situ via the second mating structure at the distal end during an operation to remove linerless media wrapped around the outer core.

In accordance with embodiments of the present disclosure, the axle is a unitary structure, the second mating structure extends in an axial direction from the distal end into the axle, the second mating structure is recessed relative to the distal end, the axle circumferentially surrounds the second mating structure, the second mating structure is integrally formed about a diameter of the distal end of the axle, and/or the second mating structure is configured to receive an operable end of a tool.

In accordance with embodiments of the present disclosure, the printer and/or media processing device includes a printhead assembly configured to move between disengaged position, in which a printhead of the printhead assembly is spaced away from the outer core, and an engaged position, in which the printhead is disposed proximate to the outer core to form a nip, the axle being automatically rotated when the printhead assembly is in the engaged position and being manually rotated when the printhead assembly is in the disengaged position.

In accordance with embodiments of the present disclosure, the printer and/or media processing device includes a housing defining an internal cavity, and the printhead assembly, the frame, the platen roller assembly, and the drive assembly are disposed in the internal cavity. An access door is moveable between a closed position which prohibits access to the internal cavity and an open position which permits access to the internal cavity. The distal end of the axle is exposed when the access door is in the open position. The axis of rotation of the axle is perpendicular to the access door when the access door is in the closed position and the distal end of the axle terminates proximate to the access door in the closed position. The printer and/or media access device can include a tool having an operable end configured to engage the second mating structure at the distal end of the axle and manually rotate the axle and/or can include the internal cavity can include a tool retaining structure configured to retain the tool within the internal cavity. The tool retaining structure can be disposed in the internal cavity on at least one of the base, front, rear, chassis, or access door.

In accordance with embodiments of the present disclosure, a method is disclosed. The method includes receiving, by a frame in an internal cavity of a printer and/or media processing device, a platen roller assembly. The platen roller assembly including an axle having a cylindrical outer surface and extending from a proximal end to a distal end that includes mating structure integrally formed therein, a first bearing disposed circumferentially about the axle proximate to the proximal end, a second bearing disposed circumferentially about the axle proximate to the distal end of the axle, an outer core disposed circumferentially about the axle between the first and second platen bearings, and a clip disposed circumferentially about the axle between the distal end and the second bearing to retain the second bearing on the axle. The method also includes engaging a drive assembly with the proximal end of the axle, driving the drive assembly to automatically rotate the axle of the platen roller assembly via the proximal end during a printing operation, and receiving an operable end of a tool via the mating structure at the distal end to manually rotate the axle in situ during an operation to remove linerless media wrapped around the outer core.

Figure 2:
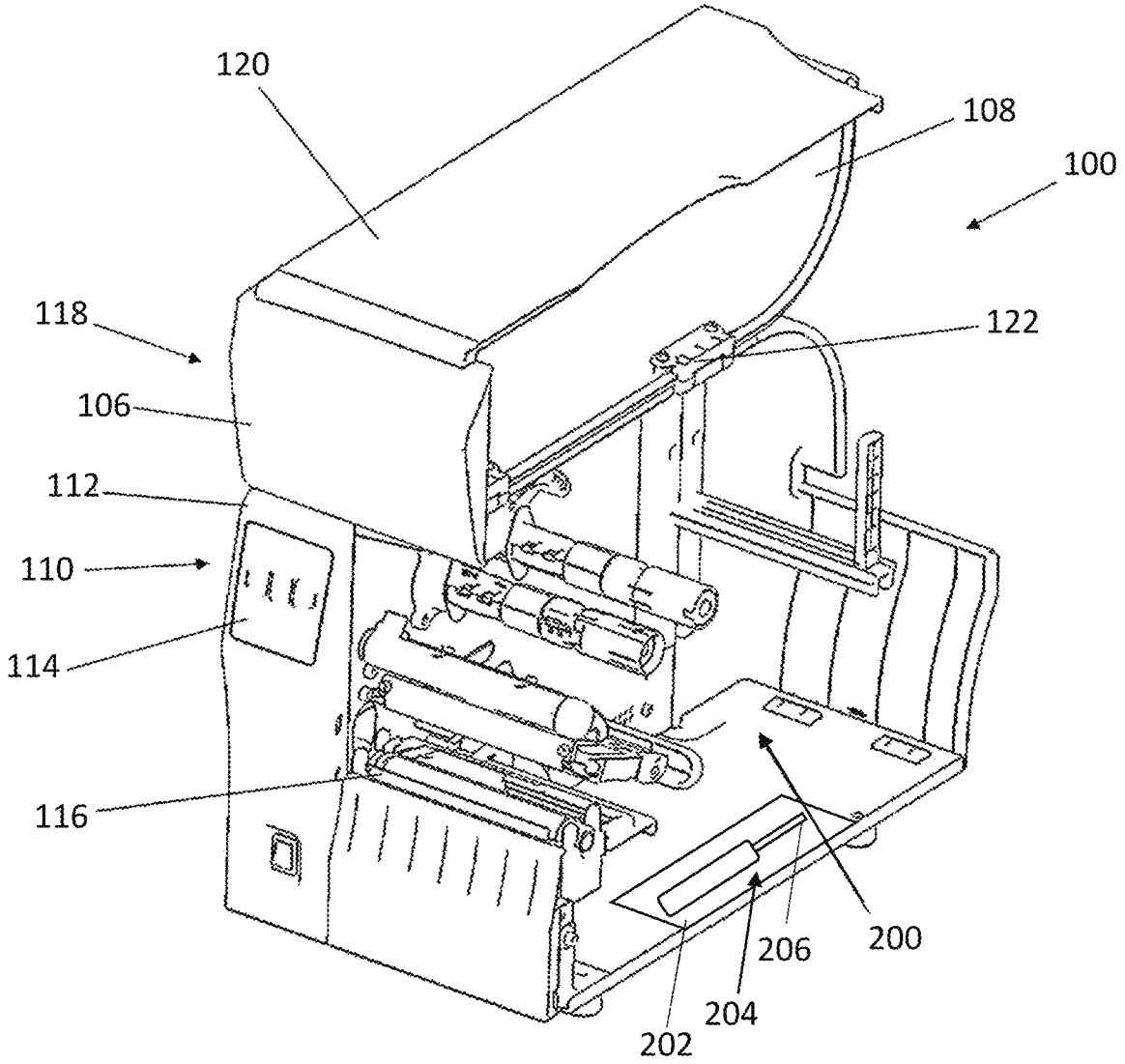
FIG. 2 illustrates the example media processing device of FIG. 1 with an access door assembly in an open position in accordance with embodiments of the present disclosure.
Figure 3:
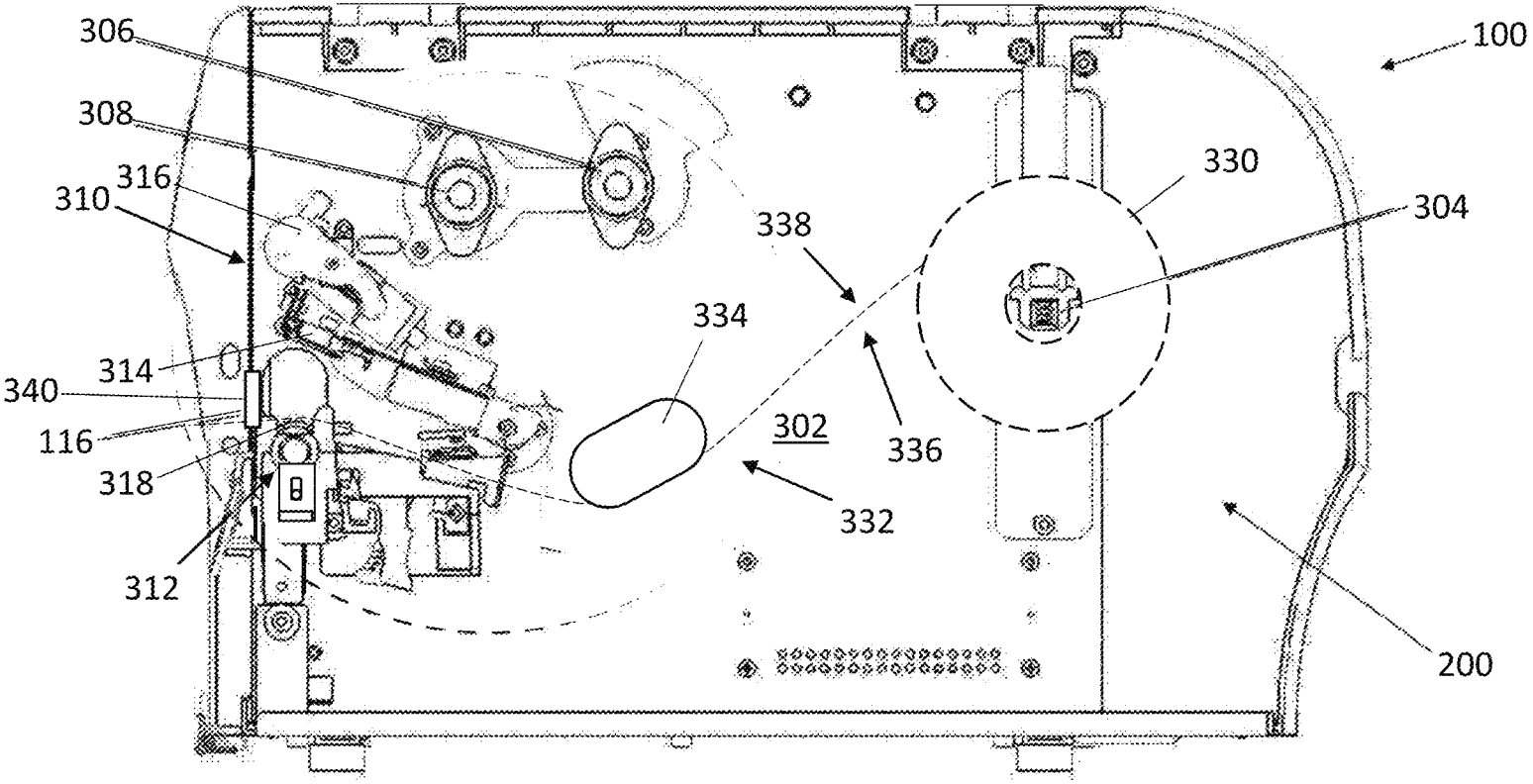
FIG. 3 illustrates a side profile of an internal cavity of the example media processing device of FIG. 1 in accordance with embodiments of the present disclosure.

FIGS. 1-3 illustrate an example of a printer and/or media processing device 100 in accordance with embodiments of the present disclosure. The media processing device 100 includes a housing 102 and a base 104. The housing 102 may include a front panel 106, a rear panel 108, a side panel 110, a support surface 112, and an access door assembly 118. The housing 102 may include a user interface 114 and a media outlet or exit 116. The media exit 116 may be arranged in the front panel 106 of the media processing device 100 and may be configured to expel media through a slot after it has been processed. The access door assembly 118 includes one or more doors 120 and can be hingedly attached to the support surface 112 with hinges 122. The access door assembly 118 is illustrated in the closed or operational position in FIG. 1, in which access to the internal components of the media processing device 100 is precluded. In addition to keeping dirt, dust, and foreign objects from entering an internal cavity of the media processing device 100 and potentially contaminating the consumables or the electronics of the processing device 100, the closed position of the access door assembly 118 may also reduce noise and prevent users from inadvertently touching sensitive components.

The access door assembly 118 may pivot about hinges 122 through a range of approximately 180 degrees to a major support position to provide access to an interior cavity 200 of the media processing device 100 in an open or non-operational position as illustrated in FIG. 2. The hinges 122 may be located proximate a centerline of the housing 102 defined between the support surface 112 and the access door assembly 118. Positioning the hinges 122 proximate a centerline of the housing 102 allows the access door assembly 118 to pivot about hinges 122 and achieve the support position when the access door assembly 118 comes to rest on the support surface 112. In some embodiments, the access door assembly 118 may include at least a portion of the front panel 106 and/or a portion of the rear panel 108 to provide greater access to the interior cavity 200 when the access door assembly 118 is positioned in the open position. Operation of the media processing device 100 may be precluded when the access door assembly 118 is in the open position.

As shown in FIGS. 2-3, when the access door assembly 118 is in the open position, components for loading and unloading consumables (e.g., print media and printer ribbon) within internal cavity 200 can be accessible and components associated with processing media along a feed path can be viewed. Access to the internal cavity 200 can be provided, for example, at least partially, through at least three sides (e.g., the front side via a portion of the front panel 106, the access door side and top side through the access door assembly 118, and/or the rear side 108 via a portion of the rear panel 319) which permit easier access and view of the components within the cavity 200. The internal cavity 200 can include a tool mount 202 and a tool 204 that can be selectively mounted and/or held by the tool mount 202. The tool 204 can include an operable end 206 that is configured and dimensioned to engage a mating structure of an axle of platen roller assembly as described herein. The tool mount 202 can be disposed or formed in or on the interior side of the front panel 106, the rear panel 108, the one or more doors 120, or a chassis (chassis 302 shown in FIG. 3).

Figure 4:
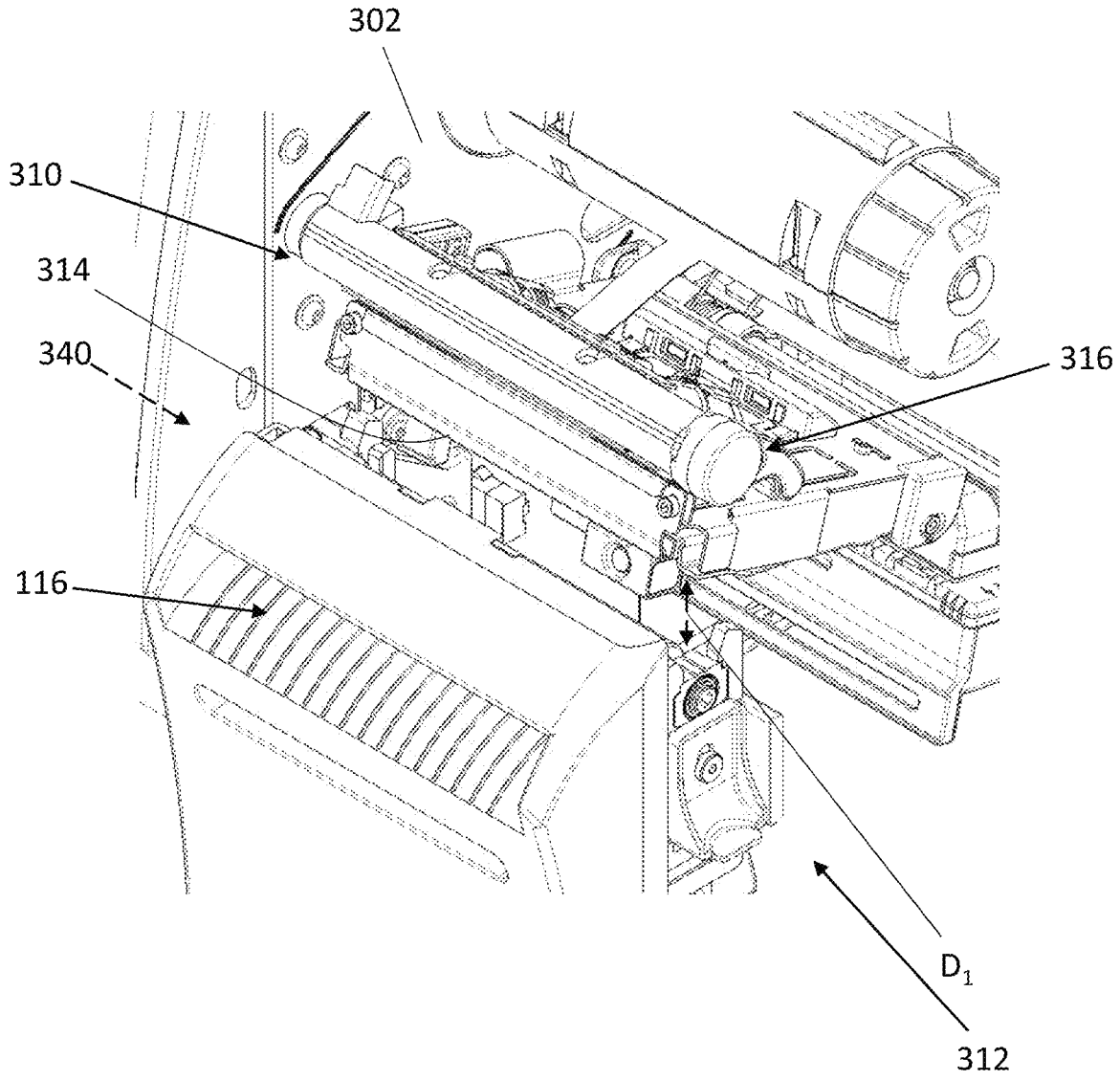
FIG. 4 illustrates a detailed view of a printing mechanism of the media processing device of FIG. 1 in accordance with embodiments of the present disclosure.

FIG. 3 illustrates a side view of the media processing device 100 with the access door assembly 320 omitted for clarity and showing the internal cavity 200 and a chassis 302 that supports at least some of the components for processing media along the feed path. FIG. 4 illustrates a more detailed view of some of the components within the internal cavity 200. Referring to FIGS. 3-4, the chassis 302 is a structural member configured to support at least some of the internal components in the internal cavity 200. The electronics and drive components (e.g., drive trains) of the media processing device 100 can be in a cavity on the other side of chassis 302 that is generally inaccessible to the user without taking the media processing device 100 apart. The electronics and drive components can control an operation of at least some of the internal components within the internal cavity 200. The internal components within the internal cavity 200 can include a media hanger 304, a ribbon supply spindle 306, a ribbon take up spindle 308, a printhead assembly 310, and a platen assembly 312. The media hanger 304 can hold a media spool or media roll (e.g., media 330). The ribbon supply spindle 306 can hold a spool of an unused portion of a ribbon while the ribbon take-up spindle 308 can hold a spool of a used portion of the ribbon. While an embodiment of the media processing device 100 has been illustrated to include ribbon supply and take-up spindles 304 and 306, respectively, embodiments of the media processing device 100 may not include ribbon supply and take-up spindles 304 and 306, e.g., for embodiments of the media processing device that do not require a ribbon to print on media (e.g., embodiments implemented via direct thermal printing). The printhead assembly 310 can include a printhead 314 (e.g., a thermal printhead) and a toggle 316. The platen assembly 312 can include a platen roller assembly 318. The printhead assembly 310 can move between a disengaged position shown in FIGS. 3 and 4, in which the printhead 314 is positioned away from the platen assembly 312 such that the printhead 314 is not positioned to print on media, and an engaged position, in which the printhead is adjacent to and forms a nip with the platen roller assembly 318 and the printhead 314 is positioned to print on media. After the printhead 314 prints on the media (e.g., via the ribbon or direct thermal), the media can be dispensed from the media processing device 100 via the media exit 116 and cut by a cutting assembly 340. The chassis 302 supports the media hanger 304, the ribbon supply spindle 306, the ribbon take-up spindle 308, the printhead assembly 310, the platen roller assembly 318, and/or the cutting assembly 340, as well as the electronics and drive components behind the chassis 302 can be operatively coupled to the media hanger 304, the ribbon supply spindle 306, the ribbon take-up spindle 308, the printhead of the printhead assembly 310, and/or the platen roller assembly 318 to control the media hanger 304, the ribbon supply spindle 306, the ribbon take-up spindle 308, the printhead assembly 310, and/or the platen roller assembly 318 (e.g., to rotate the ribbon supply spindle 306, the ribbon take-up spindle 308, and/or the platen roller assembly 318).

Figure 5:
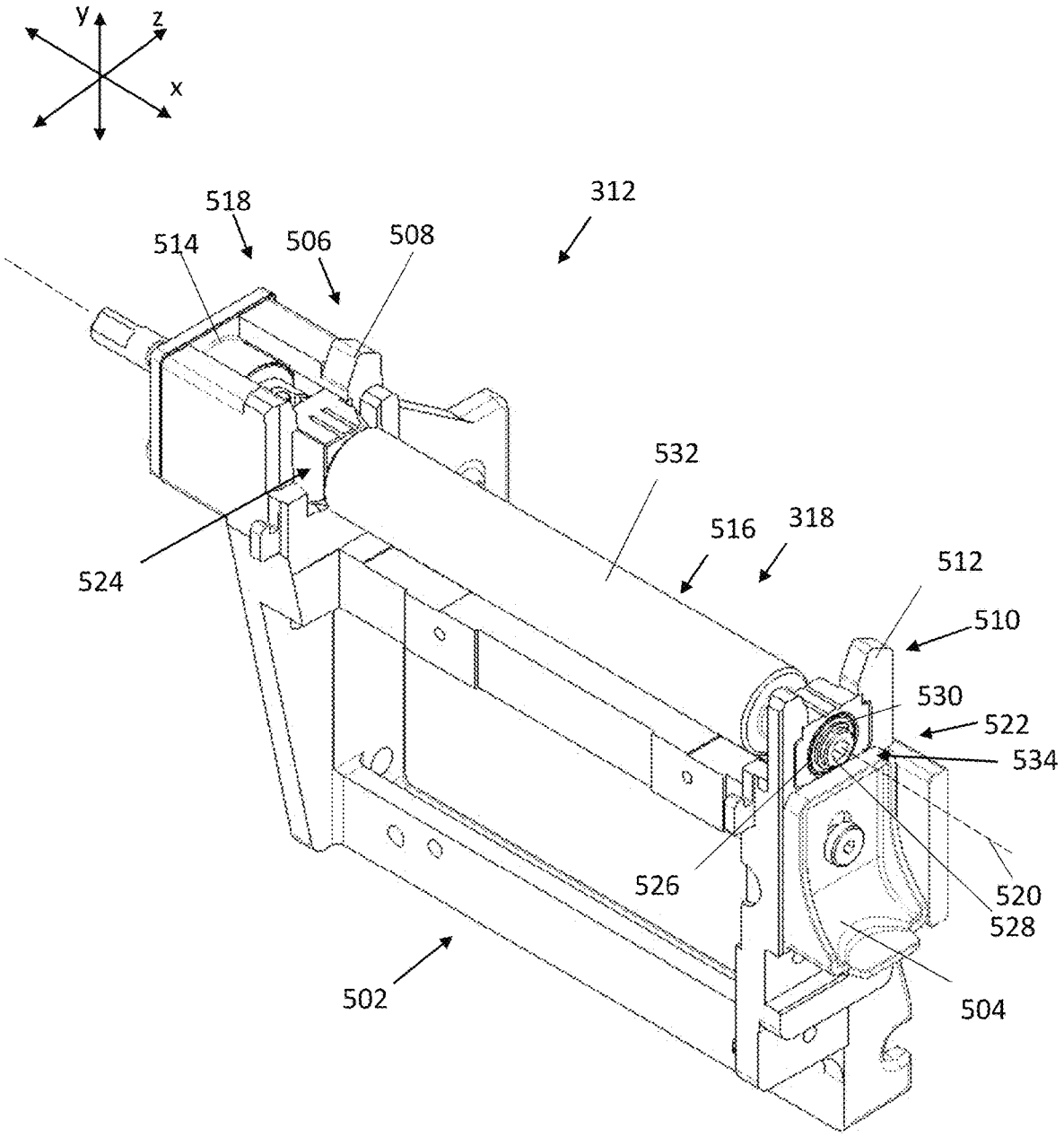
FIG. 5 illustrates a platen assembly of the media processing device of FIG. 1 in accordance with embodiments of the present disclosure.
Figure 6:
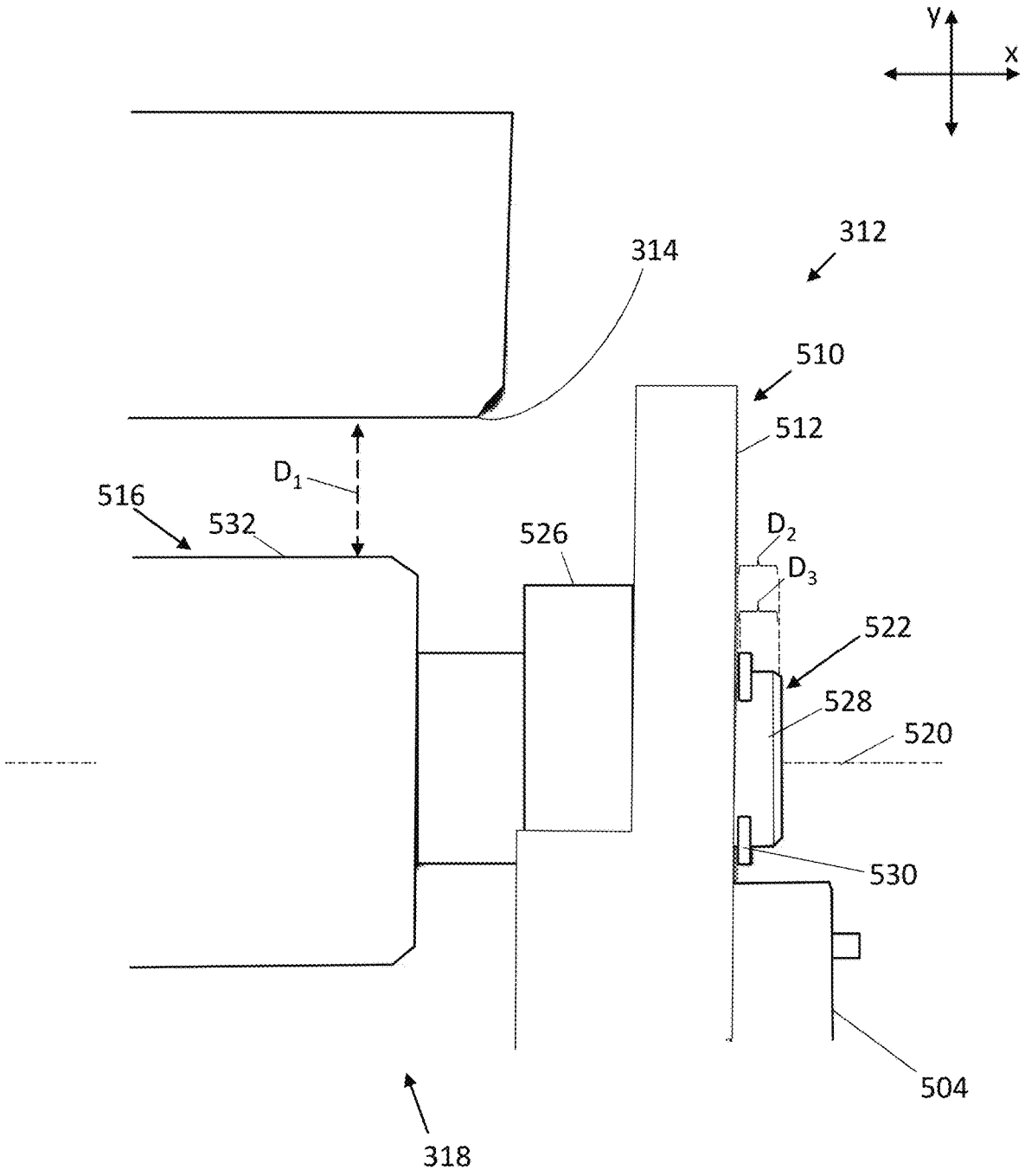
FIG. 6 illustrates a detailed view of the platen assembly of FIG. 4 in accordance with embodiments of the present disclosure.
Figure 7:
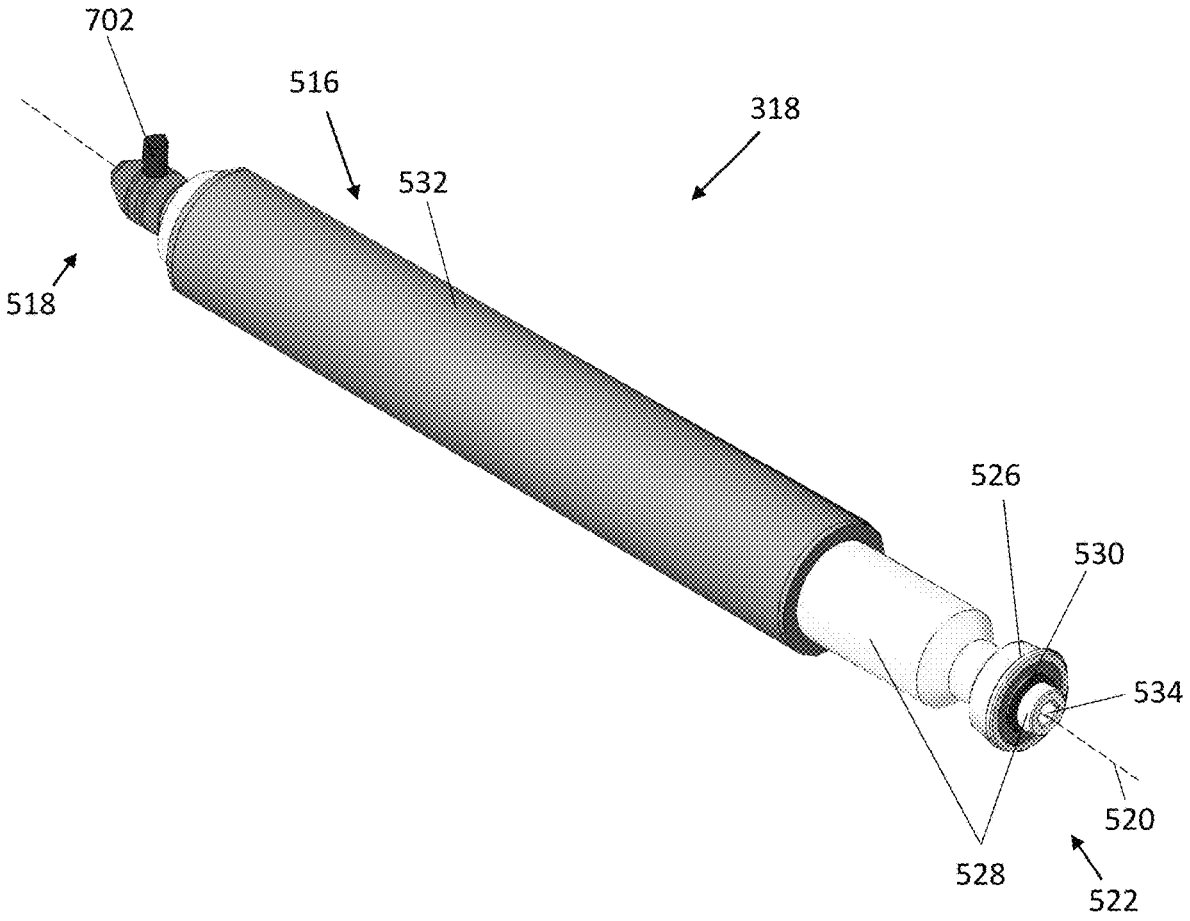
FIG. 7 illustrates a platen roller assembly in accordance with embodiments of the present disclosure.

FIG. 5 illustrates an example embodiment of the platen assembly 312. FIG. 6 illustrates a more detailed via of the distal end 522 of the platen roller assembly 318 in a frame as well as a spatial relationship of the platen roller assembly 318 relative to the second support member 510 and the printhead assembly 310 when the printhead assembly 310 is in the disengaged position. FIG. 7 illustrate an embodiment of the platen roller assembly in isolation.

As shown in FIGS. 5-7, the depicted platen assembly 312 can include a frame 502, a latch 504, and the platen roller assembly 318. The frame 502 functions to support the platen roller assembly 318 within the internal cavity 200 of the media processing device 100, while the latch 504 releasably secures the platen assembly to the frame 502. The frame 502 has first support member 506 that includes two opposing spaced prongs 508 at terminal end (extending longitudinal along a y-axis) for receiving a first portion of the platen roller assembly 318 and a second support member 510 that includes two opposingly spaced prongs 512 (extending longitudinally along a y-axis) for receiving a second portion of the platen roller assembly 318. The support members 506, 510 are spaced apart such that the platen roller assembly 318 spans across the distance between the first and second support member 506, 510.

The platen roller assembly 318 includes the platen roller 516, a first platen bearing 524, a second platen bearing 526, a platen axle 528, a locking pin (e.g., locking pin 702 shown in FIG. 7), and bearing clip 530. The bearing clip 530 can be disposed about a circumference of the platen axle 528 at the distal end 522 of the platen axle 528 to retain the platen bearing 526 on the platen axle 528. The depicted platen roller 516 defines a cylindrical body having an outer core 532 disposed circumferential about and fixed relative to the axle 528. The outer core 532 is adapted to firmly and uniformly drive media against the printhead 314. In various embodiments, the outer core 532 of the platen roller 516 may be made from a rubber or other similar material that is adapted to grip and compress media against a printhead during printing operations. The depicted platen axle 528 can be a unitary structure and/or can extends the full length of the platen roller assembly 318, through the platen roller 516 and the first and second platen bearings 524, 526. The depicted first and second platen bearings 524, 526 are structured to allow the platen axle 528 (and platen roller 516) to rotate while securely fastened in situ to the first and second support members 506, 510 of the frame 502.

Figure 8A:
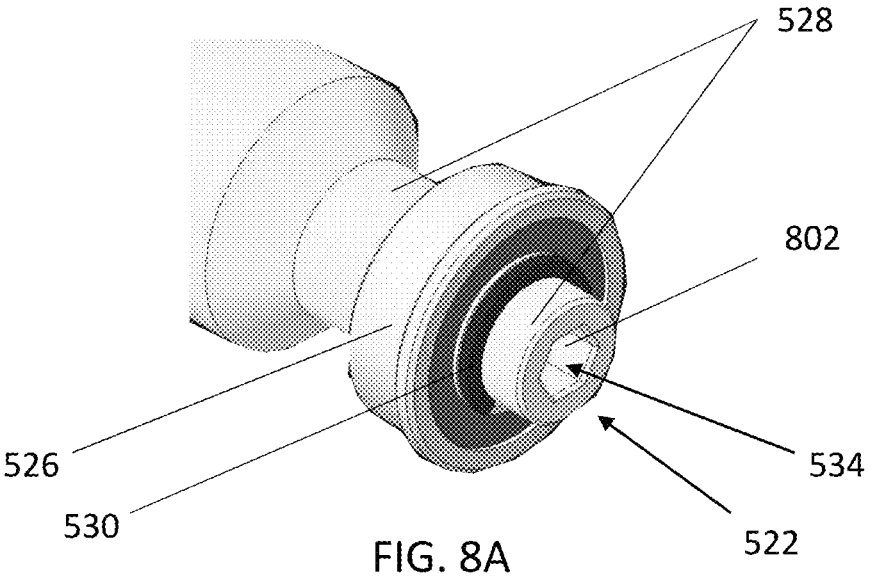
FIGS. 8A-C illustrates example mating structures at a distal end of an axle of the platen roller assembly of FIG. 6
Figure 8B:
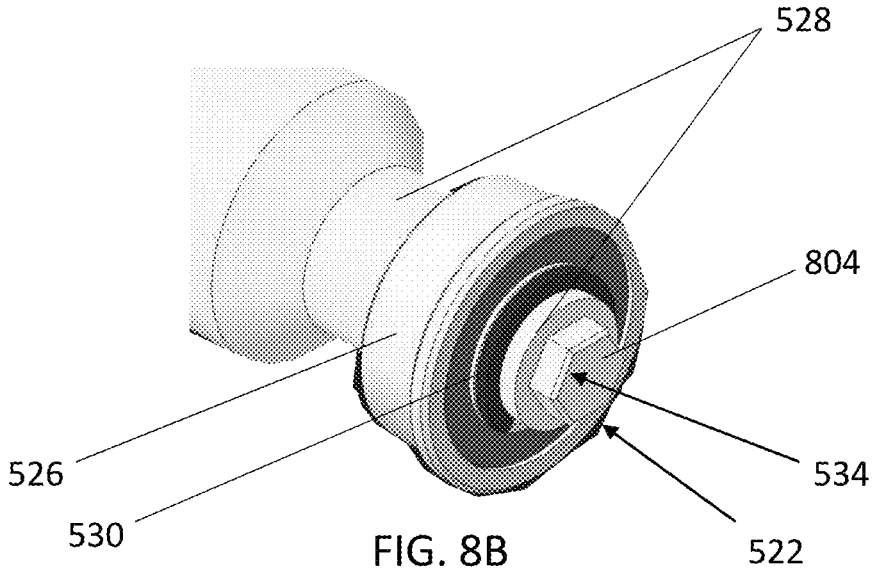
Figure 8C:
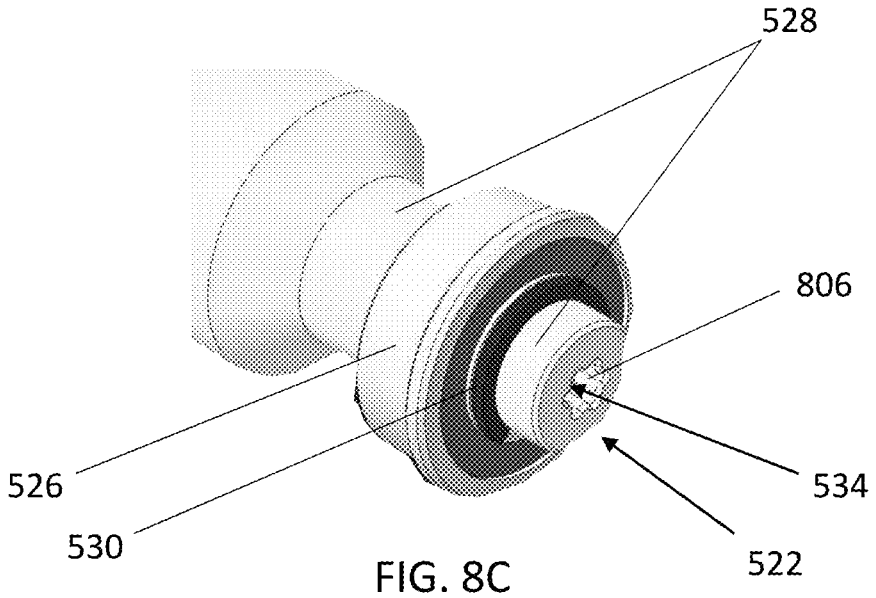

A drive assembly 514 is disposed proximate to the first support member 506 and the latch assembly 504 is disposed proximate to the second support member 510. The drive assembly 514 at least partially encloses a drive bearing, a drive shaft, and a drive coupler. The drive shaft of the drive assembly 514 can be connected to electronics and/or a drive train (e.g., including a motor and/or gears) behind the chassis 302 (shown in FIG. 3). The drive assembly 514 can be releasably coupled to a proximal or driven or end 518 of the axle 528 of the platen roller assembly 318 for driving the axle 528 and the platen roller 516 about an axis of rotation 520 (extending along the x-axis in the orientation shown in FIGS. 5-6) of the platen roller 516. A distal or non-driven end 522 of the platen roller assembly 318 is retained in the second support member 510 by the latch 504. The axis of rotation 520 of the axle 528 can be perpendicular to the at one of the one or more doors 120 of the access door assembly 118 when the access door assembly 118 is in the closed position and the distal end 522 of the axle 528 can terminate proximate to the access door 120 in the closed position. The drive coupler is adapted to receive and drive the platen axle 528 to rotate during printing operations. The platen axle 528 is configured to extend at least partially beyond the first platen bearing 524 such that a first mating structure illustrated as a locking pin 702 (shown in FIG. 7) disposed at the proximal end 518 of the axle 528 is received by a corresponding structure of the drive coupler of the drive assembly 514. Once the locking pin 702 of the platen axle 528 is seated within the drive coupler of the drive assembly 514, the drive coupler is adapted to transfer its rotational motion to the axle 528 and thereby drive the platen roller 516 during printing operations. The second platen bearing 526 is structured to be slidably received into a fixed or locked engagement with the second support member 510. The latch 504 can slide between a locked position an unlocked along the y-axis in the orientation shown in FIGS. 5-6. The latch can be biased to be in the locked position (shown in FIGS. 5-6) and can be urged downwardly along the y-axis in the orientation shown in FIGS. 5-6 to move the latch to the unlocked position to allow the platen roller assembly 318 to be removed from the frame 502. The distal end 522 of the axle 528 can include a second mating structure 534. The second mating structure 528 can be integrally formed with the axle 528 and can extend in an axial direction from the distal end 522 of the axle 528 into the axle 528 towards the proximal end 518 along the x-axis such that the second mating structure 534. The second mating structure 534 can be recessed relative to the distal end 522 of the axle 528 and the axle circumferentially surrounds the second mating structure 534 and/or the second mating structure 534 can be integrally formed about a diameter of the distal end 522 of the axle (e.g., by removing a portion of the axles about the diameter). The second mating structure 534 can be configured and dimensioned to receive and/or engage with the operable end 206 of the tool 204. FIGS. 8A-C illustrate non-limiting examples of the second mating structure 534, which can include a hex socket 802 (FIG. 8A), a hex head 804 (FIG. 8B), a star socket (FIG. 8C), and/or other mating structures. The operable end 206 of the tool 204 can have a structure that corresponds to the second mating structure, e.g., a hex bit, a hex socket, a star bit, and/or other mating structures.

As shown in FIG. 6, when the printhead assembly is in the disengaged position, the printhead 314 can be displaced away from the outer core 532 of the platen roller 516 by a distance $D_1$ (measure along the y-axis). In example embodiments, the distance $D_1$ can be approximately twenty-six millimeters (26 mm) or less than 25 mm or between approximately twelve millimeters (12 mm) and twenty-six millimeters. In example embodiments, the distal end 522 of the axle 528 can be flush with, recessed relative to, or extend beyond the prongs 512 of the second support member 510 along the x-axis. As an example, the axle can extend beyond the prongs 512 of the second support member 510 and/or the second bearing 526 by a distance $D_2$ (measure along the x-axis). The distance $D_2$ can be between one millimeter (1 mm) and six millimeters (6 mm) or can be approximately one and a half millimeters (1.5 mm) to approximately three millimeter (3 mm) or approximately two millimeters (2 mm). As shown in the example embodiment illustrated in FIG. 6, the clip 530 is disposed adjacent to the prongs 512 on a portion of the axle that extends beyond the prongs 512 such that there is a distance $D_3$ between the distal end 522 and the clip 530. The distance $D_3$ can be between zero and two and a half millimeters (2 mm) or can be approximately three quarters of a millimeter (0.75 mm) to approximately two millimeters (2 mm) or approximately one and a quarter millimeters (2.25 mm). Such distances for $D_1$-$D_3$ can make it difficult for a user to access and/or manipulate the platen roller 516 to remove linerless media that has adhered to and/or has become wrapped around the platen when the platen roller assembly 318 is secured to the frame 502 by the latch in an operational position.

In an example operation with reference to FIGS. 1-7, before a printing operation may begin, the print media (linerless media 330) is loaded into the media processing device 100. The supply of linerless media 330 (e.g., a media roll) can be supported by the hanger 304 and routed along a feed path 332 from the media supply and past the platen roller assembly 318 and printhead assembly. One or more media guides 334 can support and guide the linerless media 330 along the feed path 332. The printhead assembly 310 can be in the disengaged position such that the printhead 314 is spaced away from the platen roller assembly 318 and a gap (e.g., approximately one inch) is created between the printhead 314 and the platen roller assembly 318 which can allow a user to more easily feed the media 330 through the gap and to the media exit 116.

In addition to loading the media 330, an ink ribbon can be inserted between the printhead 314 and the platen roller assembly 318. The ink ribbon can include a supply spool and a take-up spool, each disposed on a respective spindle. The ink ribbon is fed along an ink ribbon path extending from the supply spool, around the printhead assembly 310, past the printhead 314.

After the linerless media 330 is loaded into the internal cavity 200 and fed through the media feed path 332 past a print mechanism formed the printhead 314 of printhead assembly 310 and the platen roller assembly 318 of the platen assembly 312 (and after the ink ribbon is installed), printhead assembly 310 can be moved from the disengaged position to the engaged position via the toggle 316 such that the printhead 314 and the platen roller assembly 318 for a nip. The platen roller assembly 318 can be driven to rotate about an axis of rotation to pull the linerless media through the feed path 332. The continuous web of linerless media 330 can be coated on one surface 336 with a pressure sensitive adhesive and can include a printable surface on the opposite side 338. For thermal transfer printing, the printable surface of the linerless media is configured to receive a pigment (e.g., resin, wax-resin, etc.) that is transferred from an ink ribbon installed on the ribbon supply and take-up spindles 306 and 308, respectively. For direct thermal printing, a thermal printhead of the media processing device 100 directly contacts the printable surface triggering a chemical or physical change in a thermally sensitive dye covering at least a portion of the printable surface of the media.

During a printing operation, the linerless media 330 is routed along the feed path 332 from the media supply to a print position located beneath the printhead 314. The linerless media 330 is pulled through the feed path 332 by the driven platen roller assembly 318, where the axle 528 automatically rotates in a first direction (counter clockwise in the orientation illustrated in FIG. 3) in response to rotation of the drive assembly 514 and the coupling of the drive assembly to the first mating structure 702 at the proximal end 518 during a printing operation. The linerless media 330 can be moderately biased to oppose the driving force produced by the platen roller assembly 318 to maintain tension in the web of linerless media 330 as it is pulled through the media processing device 100 by the platen roller assembly 330. The platen roller assembly is in contact with the adhesive surface 336 of the linerless media 330 as it rotates to pull the linerless media 330 through the feed path 332. Once printed, the printed portion of the linerless media 330 is advanced outwardly from the media processing device 100 through a media exit 116 by the platen roller assembly 318 where it can be cut and/or torn to separate the printed media from the media supply e.g., the cutting assembly 340 can be disposed proximate to the media outlet 116 (e.g., between the printing mechanism and the media outlet) to cut the media as it exits the media outlet 116.

As the linerless media 330 is fed through the feed path 332 and/or in response to certain conditions (environmental and/or physical), the adhesive of the linerless media 330 can cause the linerless media 330 to adhere to the platen roller assembly 318 as the axle 528 of the platen roller 516 rotates in response to the rotation of the drive assembly 514. As a result, the linerless media 330 can wrap around the platen roller assembly 318 and/or jam at the platen roller assembly 318.

The components of the media processing device 100 are typically positioned close together within the internal cavity due to operational and structural constraints and limited spaced in the internal cavity 200 and/or components within the internal cavity 200 (e.g., the media exit 116 and/or the cutter assembly 340) can obstruct access to the platen roller assembly 318, which can make it difficult for a user to remove or release the linerless media 330 that has adhered to the platen roller assembly 318 with the platen roller assembly 318 in situ (without disengaging and/or removing the platen roller assembly 318 from the frame 502). For example, the media exit is generally too narrow for a user to access and/or the cutting assembly 340 is generally positioned near the platen roller assembly 318 obstruct access. When the access door assembly 118 is in the open position to expose the internal cavity 200, the printhead assembly 310 and/or cutting assembly 340 can be positioned in a manner that makes it difficult to reach the platen roller and remove or release the media that has adhered to and/or wrapped around the platen roller 516. For example, in an engaged position, the printhead 314 is positioned adjacent to platen roller leaving just enough space for the thickness of the media to pass through. In a disengaged position, the printhead 314 can be move away from the platen roller. However, the movement of the printhead assembly is also limited such that there is typically less than about one inch between the printhead and the platen roller.

When it is determined that the linerless media 330 has adhered to and/or wrapped around the plate roller 516, it may be necessary for a user to intercede to remove and/or free the platen roller 516 of the linerless media 330. In such instances, an operation to remove or release the linerless media 330 adhered to the platen roller can be performed. The access door assembly 118 can be moved to the open position and the printhead assembly 310 can be moved to the disengaged position to release the pressure exerted on the media 330 and the platen roller 516 by the printhead 314. Using the tool 204, the user can engage the second mating structure 534 at the distal end 522 of the axle 528 with an operable end 206 of the tool to manually rotate the axle 528 in situ via the second mating structure during the operation to remove or release the linerless media adhered to and/or wrapped around the outer core 532 of the platen roller 516.

Figure 9:
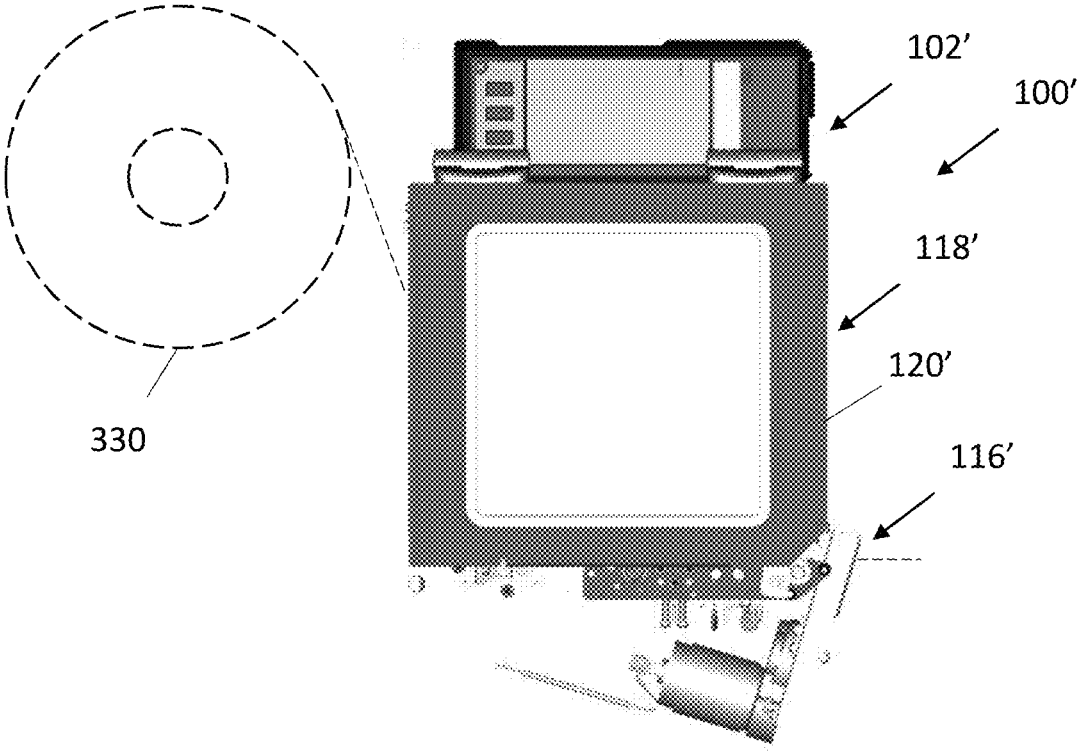
FIG. 9 illustrates another example media processing device in accordance with embodiments of the present disclosure.

FIGS. 9-12 illustrate another example media processing device 100' having a different configuration relative to the media processing device 100. The operation of the media processing device is the same or similar to the operation of the media processing device 100 described herein with reference to FIGS. 1-8. The supply of media 330 can be disposed outside of the housing 102' and can be fed through an internal cavity of the housing 102' to a media exit 116'. The media processing device 100' can include a housing 102' that includes the media exit 116' and an access door assembly 118'. A cutting assembly 340' can be disposed within the housing 102' between the media exit 116' and the print mechanism formed by the printhead assembly 310' and the platen roller assembly 318. The access door assembly 118' includes one or more doors 120'. The access door assembly 118' can transition between a closed position as shown in FIG. 9 and an open position which provides access to an internal cavity 200' that includes components of the media processing device 100', such as a printhead assembly 310' and platen assembly 312', where the printhead assembly 310' can move between an engaged position and a disengaged position via a toggle 316'.

Figure 10:
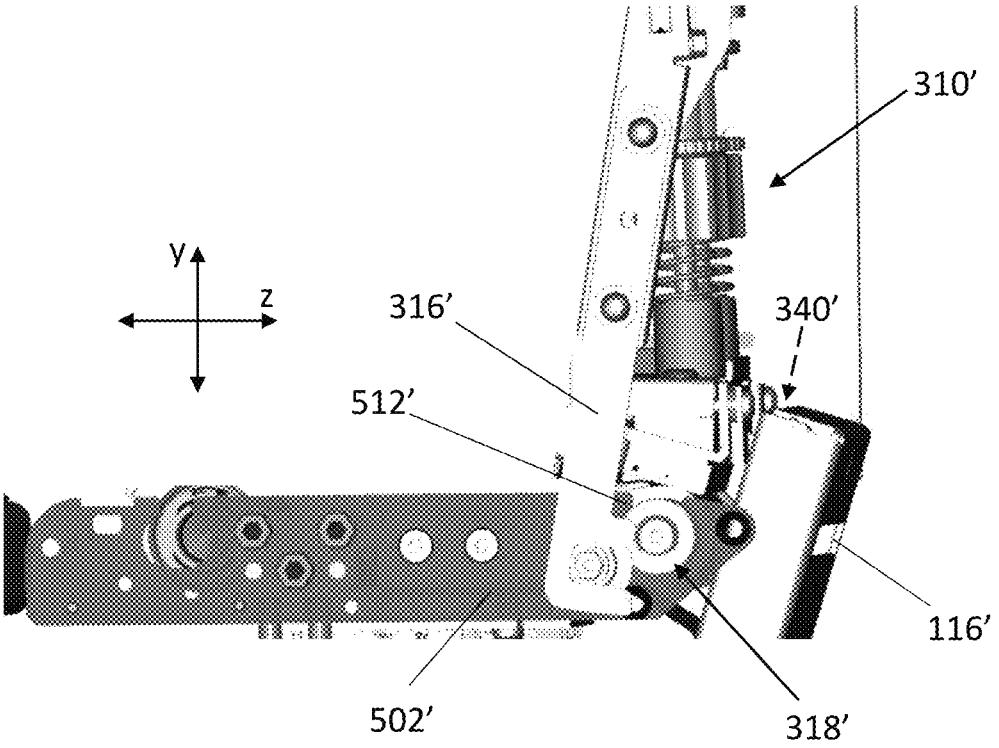
FIG. 10 illustrates a side profile view of a printing mechanism of the example media processing device of FIG. 9 in accordance with embodiments of the present disclosure.
Figure 11:
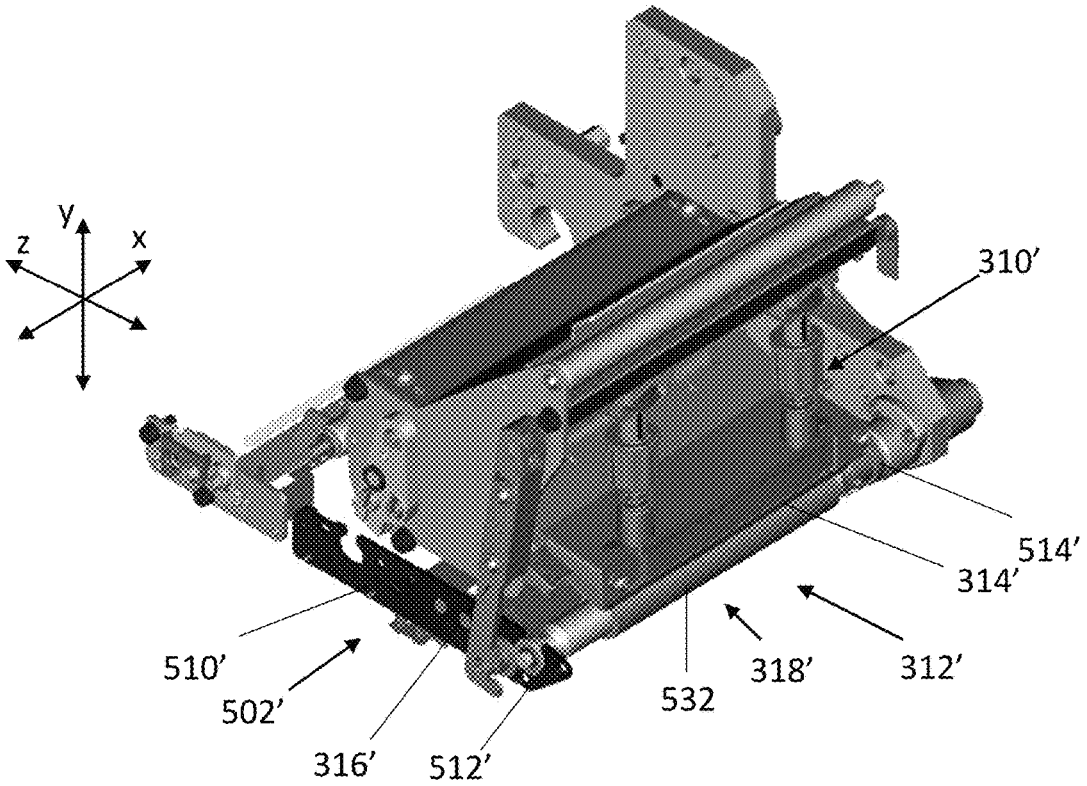
FIG. 11 illustrates a perspective view of the printing mechanism of the example media processing device of FIG. 9 in accordance with embodiments of the present disclosure.
Figure 12:
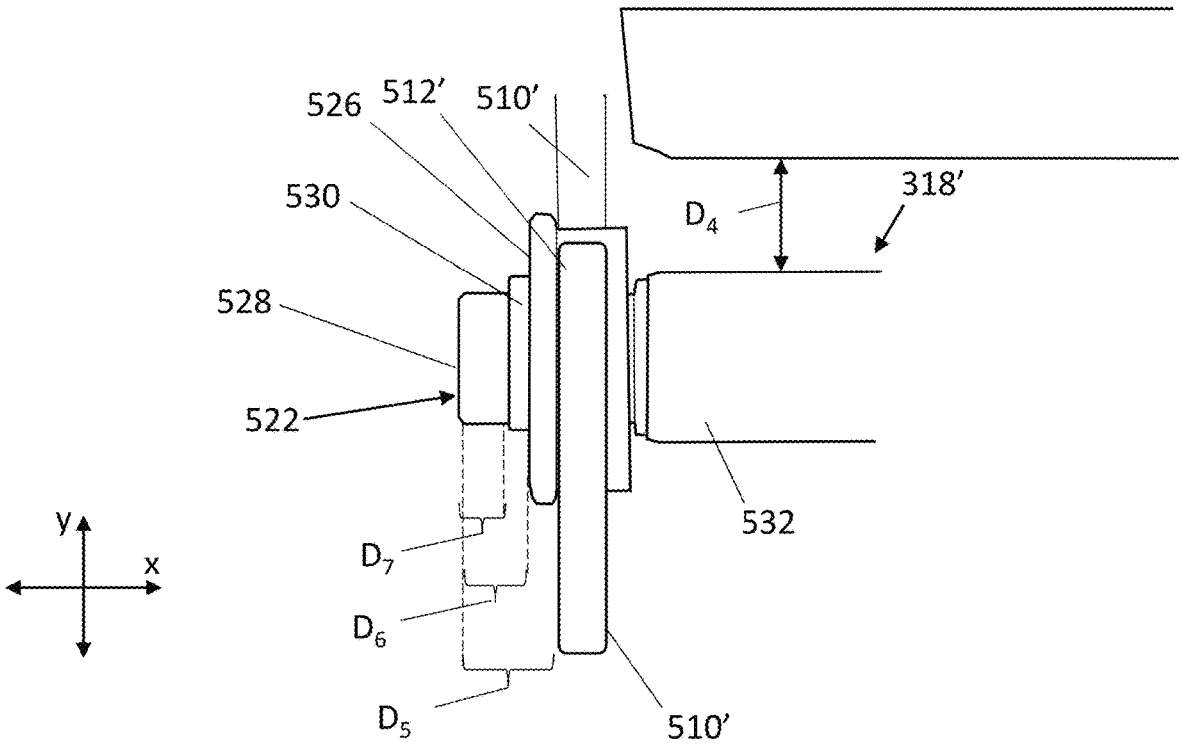
FIG. 12 is a detailed view of a portion of a platen assembly of the media processing device of FIG. 9 in accordance with embodiments of the present disclosure.

The platen assembly 312' can include a frame 502' having a support member or bracket 510' that generally extends lateral along a z-axis as oriented in FIG. 10. The support member 510' includes an area in the form of a cutout 512' for receiving the bearing 526 of the platen roller assembly 318, which also includes the platen roller 516, the first platen bearing 524, the platen axle 528, the locking pin (e.g., locking pin 702 shown in FIG. 7), and bearing clip 530, as described herein. In the disengaged position, the printhead 314' of the printhead assembly can be displaced away from the outer core 532 of the platen roller 516 by a distance $D_4$ (measured along the y-axis). The distance $D_4$ can be approximately twenty-six millimeters (26 mm) or less than 25 mm or between approximately twelve millimeters (12 mm) and twenty-six millimeters when the printhead is in the disengaged position. In example embodiments, the distal end 522 of the axle 528 can be flush with, recessed relative to, or extend beyond the support member 510', the cutout 512', and/or the second bearing 526 along the x-axis. As an example, the axle 528 can extend beyond the support member 510' and the cutout 512' (measured along the x-axis or axis of rotation 520) by a distance $D_5$. The distance $D_5$ can be between zero and nine millimeters (9 mm) or can be approximately two millimeters (2 mm) to approximately seven millimeters (7 mm) or approximately four and a half millimeters (4.5 mm). As another example, the axle 528 can extend beyond the bearing 26 (measured along the x-axis or axis of rotation 520) by a distance $D_6$. The distance $D_6$ can be approximately one millimeter (1 mm) to approximately six millimeters (6 mm) or approximately two millimeters (2 mm) to approximately four millimeters (4 mm) or approximately three millimeters (3 mm). As shown in the example embodiment illustrated in FIG. 12, the clip 530 is disposed adjacent to the bearing 526 on a portion of the axle that extends beyond the cutout 512' such that there is a distance $D_7$ between the distal end 522 and the clip 530. The distance $D_7$ can be between zero and five millimeters (5 mm) or can be approximately two millimeters (2 mm) to approximately four millimeters (4 mm) or approximately two and a half millimeters (2.5 mm). Such distances can make it difficult for a user to access and/or manipulate the platen roller 516 in situ to remove linerless media that has adhered to and/or has become wrapped around the platen when the platen roller assembly 318 is secured to the frame 502' in an operational position. Likewise, the media exit 116' and the cutting assembly 340' can impede access to and manipulation of the platen roller 516.

The above description refers to diagrams of the accompanying drawings. Alternative implementations of the example represented by the diagrams include one or more additional or alternative elements, processes and/or devices. Additionally or alternatively, one or more of the example elements of the diagram may be combined, divided, rearranged or omitted.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The invention claimed is:

1. A printer, the printer comprising:

a platen roller assembly comprising:

an axle having a cylindrical outer surface and extending from a proximal end to a distal end, a first bearing disposed circumferentially about the axle proximate to the proximal end, a second bearing disposed circumferentially about the axle proximate to the distal end of the axle, and an outer core disposed circumferentially about the axle between the first and second platen bearings, the proximal end of the axle including a first mating structure having at least one project extending radially from the axle, the distal end of the axle having a second mating structure integrally formed at the distal end;

a frame supporting the platen roller assembly; and a drive assembly operatively coupled to the first mating structure at the proximal end of the axle, the axle of the platen roller assembly being automatically rotated via the drive assembly coupled to the first mating structure at the proximal end during a printing operation and being manually rotated in situ via the second mating structure at the distal end during an operation to remove linerless media wrapped around the outer core.

2. The printer of claim 1, wherein the axle is a unitary structure.

3. The printer of claim 1, wherein the second mating structure extends in an axial direction from the distal end into the axle.

4. The printer of claim 3, wherein the second mating structure is recessed relative to the distal end.

5. The printer of claim 4, wherein the axle circumferentially surrounds the second mating structure.

6. The printer of claim 3, wherein the second mating structure is integrally formed about a diameter of the distal end of the axle.

7. The printer of claim 1, wherein the distal end of the axle extends beyond at least one of the frame or the second bearing by less than approximately one-hundredth of an inch and the second mating structure is configured to receive an operable end of a tool.

8. The printer of claim 1, further comprising:

a printhead assembly configured to move between disengaged position, in which a printhead of the printhead assembly is spaced away from the outer core, and an engaged position, in which the printhead is disposed proximate to the outer core to form a nip, the axle and outer core being automatically rotated when the printhead assembly is in the engaged position and being manually rotated when the printhead assembly is in the disengaged position.

9. The printer of claim 8, further comprising:

a housing defining an internal cavity, the printhead assembly, the frame, the platen roller assembly, and the drive assembly being disposed in the internal cavity;

an access door moveable between a closed position which prohibits access to the internal cavity and an open position which permits access to the internal cavity, the distal end of the axle is exposed when the access door is in the open position.

10. The printer of claim 9, wherein the axis of rotation of the axle is perpendicular to the access door when the access door is in the closed position and the distal end of the axle terminates proximate to the access door in the closed position.

11. The printer of claim 9, further comprising:

a tool having an operable end configured to engage the second mating structure at the distal end of the axle and manually rotated the axle; and a structure configured to retain the tool within the internal cavity.

12. The printer of claim 11, wherein the structure is disposed in the internal cavity on at least one of the base, front, rear, chassis, or access door.

13. The platen roller assembly of claim 1, wherein the axle is a unitary structure.

14. The platen roller assembly of claim 1, wherein the second mating structure extends in an axial direction from the distal end into the axle.

15. The platen roller assembly of claim 14, wherein the second mating structure is recessed relative to the distal end.

16. The platen roller assembly of claim 15, wherein the axle circumferentially surrounds the second mating structure.

17. The platen roller assembly of claim 14, wherein the second mating structure is integrally formed about a diameter of the distal end of the axle.

18. A platen roller assembly for a printer, the platen roller assembly comprising:

an axle having a cylindrical outer surface and extending from a proximal end to a distal end;

a first bearing disposed circumferentially about the axle proximate to the proximal end;

a second bearing disposed circumferentially about the axle proximate to the distal end of the axle;

an outer core disposed circumferentially about the axle between the first and second platen bearings; and a clip disposed circumferentially about the axle between the distal end and the second bearing to retain the second bearing on the axle, the proximal end of the axle includes a first mating structure configured and dimensioned to engage a drive assembly of the printer and the distal end of the axle includes a second mating structure integrally formed therein that is configured and dimensioned to receive an operable end of a tool.

19. A method comprising:

receiving, by a frame in an internal cavity a printer, a platen roller assembly, the platen roller assembly including an axle having a cylindrical outer surface and extending from a proximal end to a distal end that includes a amating structure integrally formed therein, a first bearing disposed circumferentially about the axle proximate to the proximal end, a second bearing disposed circumferentially about the axle proximate to the distal end of the axle, an outer core disposed circumferentially about the axle between the first and second platen bearings, and a clip disposed circumferentially about the axle between the distal end and the second bearing to retain the second bearing on the axle;

engaging a drive assembly with the proximal end of the axle;

driving the drive assembly to automatically rotate the axle of the platen roller assembly via the proximal end during a printing operation; and receiving an operable end of a tool via the mating structure at the distal end to manually rotate the axle in situ during an operation to remove linerless media wrapped around the outer core.

20. The method of claim 19, wherein the axle is a unitary structure, the mating structure extends in an axial direction from the distal end into the axle, and the surface mating structure is at least one of recessed relative to the distal end or formed about a diameter of the distal end of the axle.

* * * * *